United States Patent [19]

Miller

[11] Patent Number: 4,811,932

[45] Date of Patent: Mar. 14, 1989

[54] COIL SPRING MATTRESS CORE

[75] Inventor: John E. Miller, Tupelo, Miss.

[73] Assignee: Parma Corporation, Denton, N.C.

[21] Appl. No.: 70,341

[22] Filed: Jul. 6, 1987

[51] Int. Cl.[4] ..... F16F 3/02

[52] U.S. Cl. ..... 267/95; 5/250; 5/475; 267/91; 267/105

[58] Field of Search ..... 267/95, 91, 101, 87, 267/88, 103, 105, 108; 5/250, 248, 256, 257, 267, 275, 475, 268, 269

[56] References Cited

U.S. PATENT DOCUMENTS

| | | | |
|---|---|---|---|
| 2,305,530 | 12/1942 | Hopkes | 267/87 |
| 2,570,409 | 10/1951 | Hove | 267/88 |
| 2,729,830 | 1/1956 | Gleason | 267/87 X |
| 3,084,353 | 4/1963 | Levine | 5/275 X |
| 3,457,572 | 7/1969 | Rymland | 5/475 X |
| 3,983,910 | 10/1976 | Dasher | 5/267 X |
| 4,180,877 | 1/1980 | Higgins | 5/267 X |
| 4,426,070 | 1/1984 | Garceau et al. | 267/91 |
| 4,654,905 | 4/1987 | Miller | 5/267 X |

FOREIGN PATENT DOCUMENTS

| | | | |
|---|---|---|---|
| 176865 | 3/1922 | United Kingdom | 5/269 |
| 485342 | 5/1938 | United Kingdom | 5/269 |
| 708781 | 5/1954 | United Kingdom | 267/101 |

*Primary Examiner*—George E. A. Halvosa
*Attorney, Agent, or Firm*—William E. Mouzavires

[57] ABSTRACT

A mattress core particularly useful in a sofa bed has a plurality of rows of coil springs extending longitudinally of the coil in the head to foot direction thereof. A plurality of coiled spring wires extend transversely of the rows while interconnecting adjacent coil springs in each row and adjacent coil springs of adjacent rows by being wound about the coil springs. The coiled spring wires are located on opposite sides of the core. On only one side of the core which forms the sleep surface are a plurality of transversely extending "torsion" spring wires, however, these wires are of a generally rectilinear shape with intermediate offset portions at intervals extending generally along the head to foot direction while being connected to the coil springs of each of the rows. The offset portions provide torsion arms providing torsional resistance to deflection at the sleep surface to thereby increase resistance to deflection while, at the same time, distributing loads across the sleep surface. The bottom side of the core opposite the sleep surface does not have the torsion wires and is therefore more flexible than the spring surface to facilitate compression of the core when moved into the sofa mode.

11 Claims, 3 Drawing Sheets

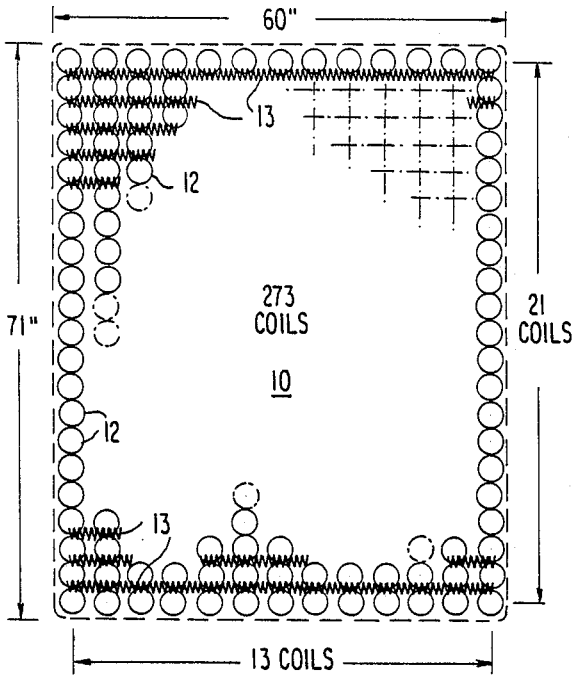
FIG. 1
PRIOR ART
FIG. 2
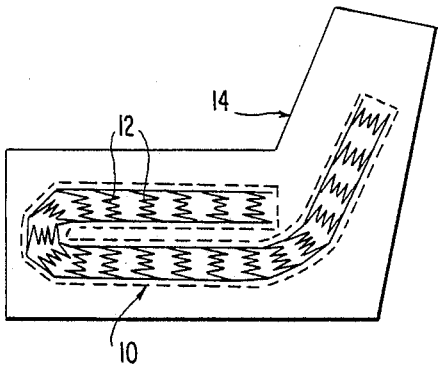
FIG. 3
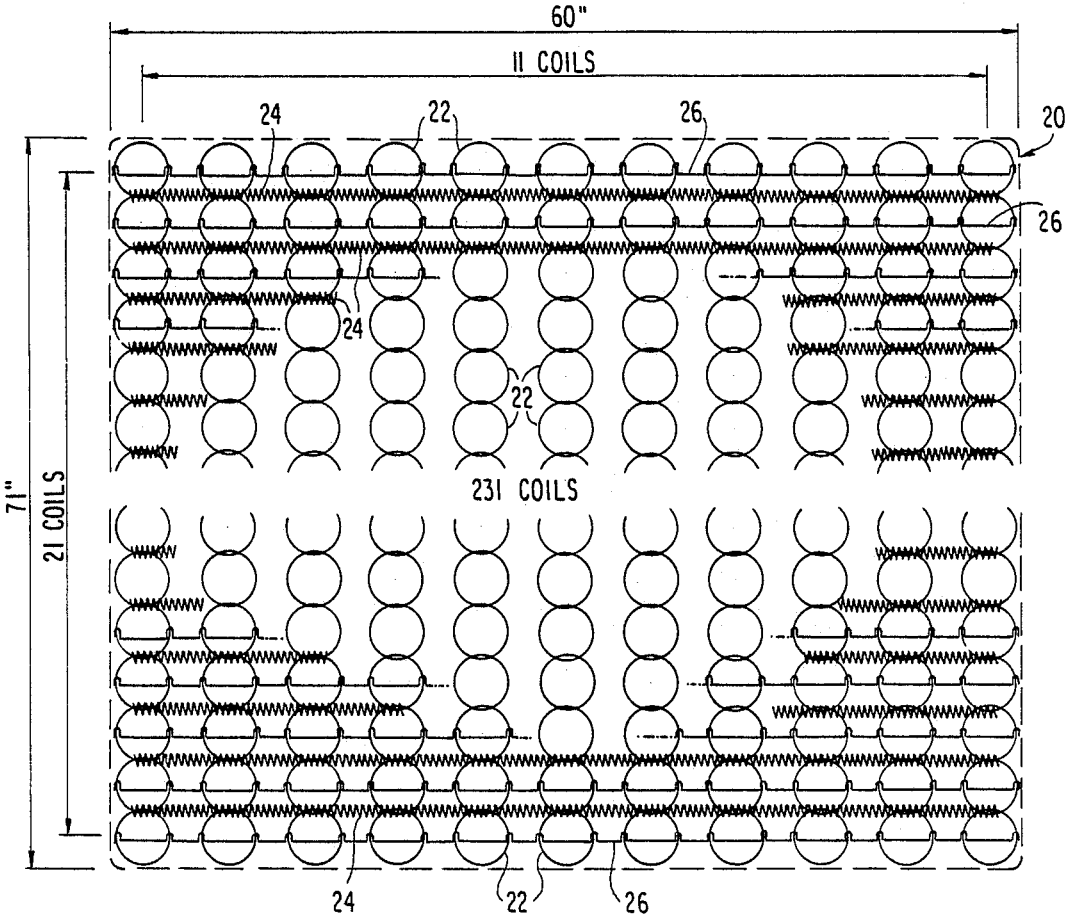

COIL SPRING MATTRESS CORE

RELATED PATENT

The invention of the present application is somewhat related to one of the inventions disclosed in my prior U.S. Pat. No. 4,654,905, issued Apr. 7, 1987 and assigned to the same assignee of the present application.

BACKGROUND OF THE INVENTION

Mattresses for sofa beds have been noted for providing poor sleeping comfort due in large part to the necessity of being folded into a limited space when converting the sofa bed to the sofa mode. In order to permit folding into the limited space requirements of the sofa bed frame, the mattresses have been constructed with a relatively minimal depth dimension which detracts from the comfortability of the mattress when used in the bed mode of the sofa bed.

More recently, some sofa bed mattresses have been constructed with a conventional arrangement of coil springs to give, for example, a seven inch mattress height when unfolded into the bed mode. However, in order to permit the mattress to be folded and compressed into the limited space of the frame when converted to the sofa mode, a special, large, "big box" mechanism for folding the bed and mattress must be used which results in an additional disadvantage of requiring the front rail of the sofa bed to be raised to accommodate the large mechanism. These requirements not only increase the cost of manufacture but also prevent desired low rail styling to be achieved. While it is possible to construct and arrange the coil springs to have a high degree of flexibility to allow the mattress to be compressed and folded into the limited space of the frame with a conventional size linkage mechanism, the resulting mattress is too soft to provide desired comfort when unfolded for use as a sleep mattress.

OBJECTS OF THE PRESENT INVENTION

An object of the present invention is to provide a novel and improved coil spring mattress particularly suitable for a sofa bed although the mattress of the invention need not be limited to use with sofa beds. Included herein is the provision of a coil spring mattress core which overcomes the problems noted above so that the mattress core may be used with conventional linkage mechanisms of a sofa bed and without requiring the height of the sofa rail to be increased above conventional or modern-day standards.

Another object of the present invention is to provide a coil spring mattress which may be used in a sofa bed and yet will be highly comfortable when used as a sleep mattress.

Another object of the present invention is to provide a coil spring mattress and/or mattress core having a novel and improved construction. Included herein is such a mattress or core that will not only provide improved sleeping comfort but is also more economical to manufacture than conventional coil spring mattresses or cores.

SUMMARY OF THE INVENTION

In one preferred embodiment, the mattress of the present invention includes a core comprised of a plurality of rows of coil springs with a plurality of coiled wires interconnecting the rows across one direction of the mattress on the opposite top and bottom sides thereof. The wires are coiled about the coils so that they also connect adjacent coils in each of the rows of coil springs. On only one side of the mattress core which forms the sleep surface are a plurality of additional, torsion wires extending over the tops of the coil springs between the coiled wires. These torsion wires include a plurality of offset portions spaced along the length thereof and connected to the coil springs such that the offset portions provide torsion arms about which the torsion wires are free to deflect in torsion to increase the resistance of the sleep surface while further integrating the coil springs. The bottom surface of the coil is not provided with torsion wires so that the coil springs in that area are more flexible to facilitate the folding of the mattress core.

DRAWINGS

Other objects and advantages of the present invention will be apparent from the following more detailed description taken in conjunction with the attached drawings in which:

FIG. 1 is a plan view of a conventional queen size, coil spring, mattress core illustrating prior art;

FIG. 2 is a schematic end view of a sofa bed showing how a typical mattress is folded when the sofa bed is in the sofa mode;

FIG. 3 is a top plan view of a queen size mattress core constructed in accordance with a preferred embodiment of the present invention with some portions removed for clarity;

DETAILED DESCRIPTION

Figure 4:
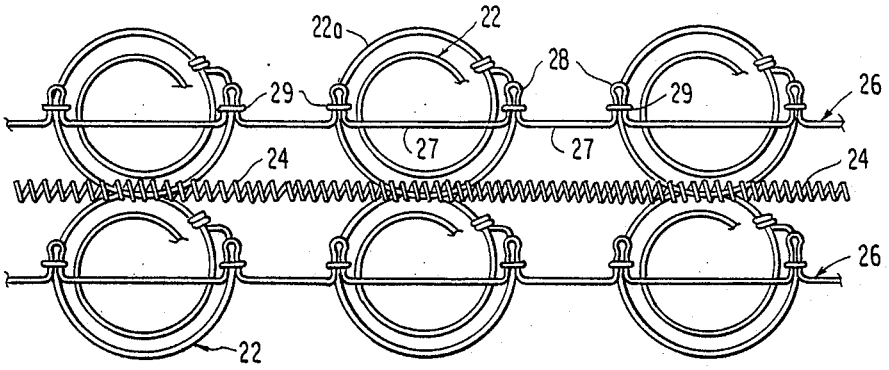
FIG. 4 is an enlarged fragmental plan view of a top section of the core shown in FIG. 3.
Figure 5:
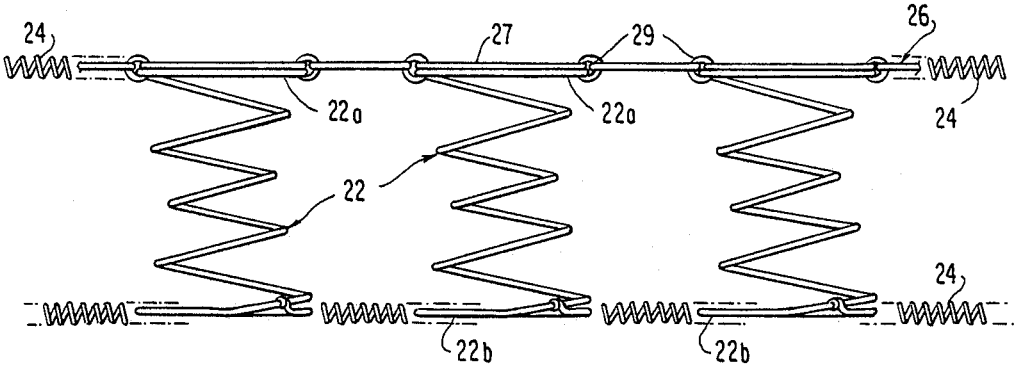
FIG. 5 is an elevational view of the section shown in FIG. 4.

Referring now to the drawings in detail, there is illustrated in FIG. 1 a mattress core of the prior art for a queen size bed, the core including thirteen rows of conventional coil springs 12 extending in the longitudinal direction of the core with each row including twenty-one coil springs making a total of two hundred and seventy-three coil springs. As indicated, the coil springs 12 are conventional Bonnell-type coil springs which include helical runs as indicated in FIGS. 4 and 5 and which are typically five to five and one-quarter inches (5"–5¼") high to produce a seven inch high mattress after tufting. The rows of coil springs are interconnected by helical wires 13 wound about the upper and lower helical runs of the coil springs respectively. Helical wires 13 are also respectively wound about the upper and lower wires of adjacent coil springs 12 in each row to thus also interconnect the adjacent coil springs of each row.

When used in a sofa bed such as illustrated at 14 in FIG. 2, the core 14 must be folded into the layered configuration shown in FIG. 2 and this, of course, requires that the coil springs 12 be compressed in order to allow the core to fit into the interior of the sofa bed whose size is limited in order to meet the design criteria of the sofa bed. As can be readily appreciated, the compression of 273 coil springs requires a considerable force (on the order of 3822 lbs. for a typical queen size mattress) to be applied through a linkage mechanism which must withstand such forces. As a result, a large or special linkage mechanism must be used but this detracts from present-day styling requirements of the sofa bed. While attempts have been made to decrease the strength of the coil springs, this detracts from sleeping comfort as the mattress becomes too soft.

In accordance with the present invention, the above problem is solved by decreasing the number of coil springs to lessen the force required to fold the mattress, and adding load distribution and resistance wires only at the sleep surface adjacent the top of the core to strengthen the sleep surface to provide a comfortable and sufficiently firm sleeping surface. It is preferred that these wires be made of spring wire material and that they include torsion arms providing torsional resistance to bending when the mattress is loaded during use.

In one preferred embodiment, such as shown in FIGS. 3 through 6 and which is for use in a queen size mattress, the rows of coil springs 22 are reduced from thirteen as used in the prior art of FIG. 1 to eleven as shown in FIG. 2. The spacing between the rows is increased so that the overall width of the core remains as sixty inches in accordance with the standard queen size. The number of coil springs 22 in each row of the core of the preferred embodiment remains as twenty-one so that the total number of coil springs is reduced from 273 to 231, giving a reduction of about 588 lbs. of force required to compress the coil springs.

As shown in FIG. 3, the rows of coil springs 22 are interconnected by helical wires 24 which also respectively interconnect adjacent coil springs 22 in each row of coil springs 22. In a queen size mattress core such as shown in FIG. 3, twenty helical wires 24 are utilized to connect the coil spring rows at the top or sleeping surface. An additional twenty helical wires 24 are utilized to interconnect the rows at the bottom of the core which is not shown in FIG. 3 but which is partly shown in FIG. 5. The helical wires 24 are wound about preferably the top runs **22*a* of the coil springs 22 at the sleep surface as shown in FIG. 4 and the bottom runs 22*b* at the bottom of the core as shown in FIG. 5**.

Further, in accordance with the invention, the rows of coil springs 22 are interconnected at the upper portion of the mattress core by a plurality of what will be termed "torsion wires" 26 extending transversely of the core and spaced along the longitudinal direction of the core at generally the central portions of the coil springs 22 as shown in FIG. 3. In the preferred embodiment shown, there are twenty-one torsion wires 26 corresponding to the twenty-one coil springs 22 in each row, and the torsion wires extend generally diametrically over the topmost runs **22*a* of the coil springs. Torsion wires 26 are made preferably of spring wire material and include, in the preferred embodiment, rectilinear or straight portions 27 and a plurality of offset portions termed herein "torsion arms" 28 spaced along the length thereof and extending transversely of the rectilinear portions 27. In the preferred embodiment of FIG. 4, the torsion arms 28 are provided in spaced pairs to be attached to oppostie portions of the upper runs 22*a* of the coil springs 22**.

Figure 6:
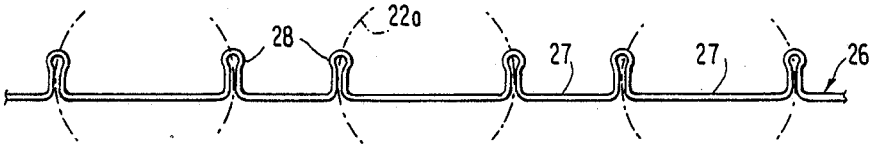
FIG. 6 is a fragmental plan view of a torsion spring included in the preferred embodiment of FIGS. 4 and 5 and with coil springs shown in phantom lines.

In the preferred form shown in FIGS. 4 and 6, torsion arms 28 are of a generally inverted U shape and they are attached to the upper runs **22*a* by any suitable means such as the shown ring clips 29 which extend about both legs of the torsion arms 28 and about the upper run 22*a* of the associated coil spring. Torsion wires 26 distribute the loads from coil spring to coil spring while providing the desired resilient resistance to deflection at the sleep surface. It will also be seen that in resisting deflection, the rectilinear portions 27 of the spring wires 26 are deflectable in torsion about the torsion arms 28 which are attached to the upper runs 22*a* of the coil springs. In addition, the rectilinear portions 27 extend over the uppermost run 22*a* of the coil springs and also serve to prevent the lower coil spring runs from rising above the upper run 22*a* to thus maintain the shape and integrity of the coil springs 22**.

It should be noted that only the sleep surface is enhanced with the torsion wires 26 and that the bottom of the core is purposely not provided with the torsion wires 26. This imparts a desired amount of flexibility to allow the necessary compression of the coils springs during folding movement of the sofa bed into the sofa mode. It will thus be seen that the present invention reduces the force necessary to compress the coil springs during folding of the sofa bed, and at the same time allows a seven inch mattress to be employed with a firm sleep surface that will provide the necessary resistance to load while uniformly distributing the loads to provide a comfortable sleep surface.

Figure 7:
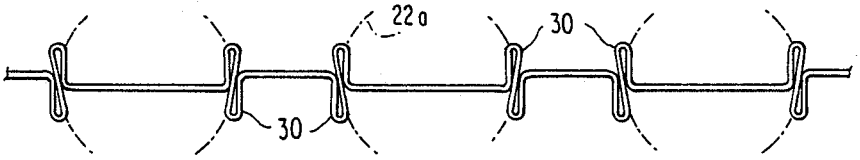
FIGS. 7 and 8A are plan views similar to FIG. 6 but respectively illustrating two additional or modified torsion wires that may also be used in the mattress core of the present invention.

The amount of torsional resistance offered by the torsion wires may be varied by the use of different sizes and shapes of the torsion arms. For example, FIG. 7 shows generally inverted S shape torsion arms 30 attached to opposite portions of the upper coil spring runs **22*a* shown in phantom in FIG. 7. The torsion arms 30 may be attached to the runs 22*a* by any suitable means (not shown in FIG. 7) such as the clips 29** described above.

Figure 8A:
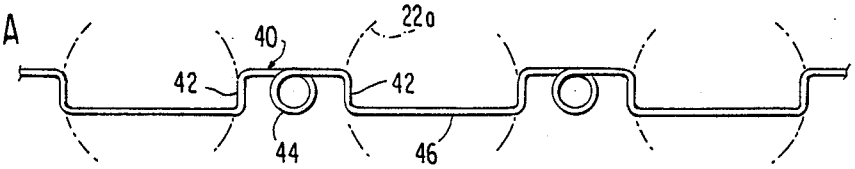
Figure 8B:
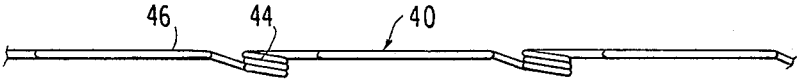
FIG. 8B is an elevational view of the torsion wire of FIG. 8A.

FIGS. 8A and 8B disclose another type of torsion arm 40 having a generally inverted U shape including legs 42 to be attached to the upper coil spring runs **22*a*, a yoke portion interconnecting the legs 42 and including a coil 44 located between adjacent coil springs of adjacent rows. Torsion arms 40 not only provide torsional movement about legs 42 but also about the coil 44. Like the above-described torsion wires, the torsion wire shown in FIGS. 8A and 8B is made from one piece of spring wire, that is, the torsion arms 40 are integrally formed with the rectilinear portions 46**.

Figure 9A:
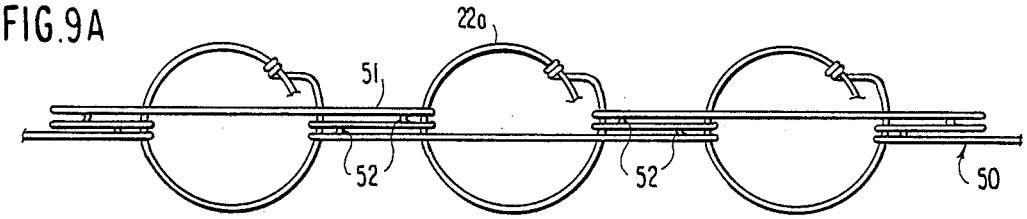
FIG. 9A is a plan view similar to FIG. 6 but illustrating another torsion wire that may be used in the mattress core of the present invention.
Figure 9B:
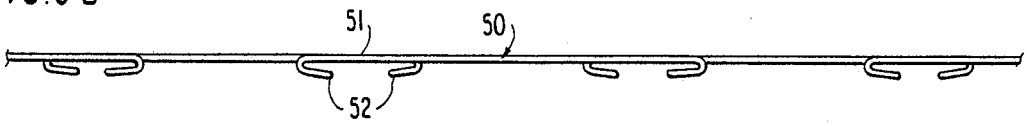
FIG. 9B is an elevational view of the torsion wire shown in FIG. 9A.

FIGS. 9A and 9B illustrate another type of torsion wire 50 including integrally formed torsion arms 51 including hook portions 52 which may be snapped on to engage about the upper coil spring runs **22*a* and eliminate the need of the attachment means such as the ring clips 29** described above.

Figure 10:
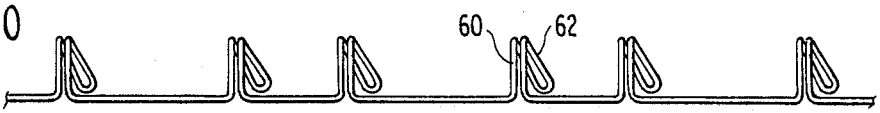
FIGS. 10 and 11 are plan views respectively of two other torsion wires that may be used in the mattress core of the present invention.
Figure 11:
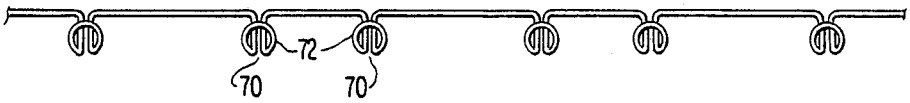

FIGS. 10 and 11 illustrate other torsion arms 60 and 70 respectively which have portions 62 and 72 that may be bent or wrapped about the upper coil spring runs to attach the torsion wires thereto.

Figure 12:
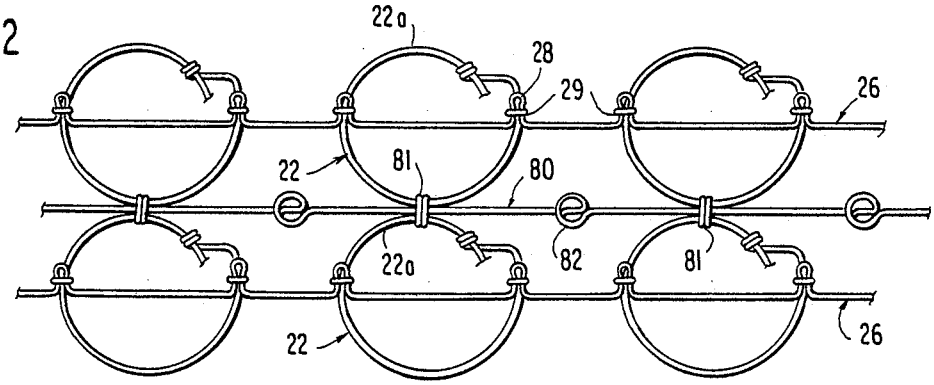
FIG. 12 is a fragmental, top plan view of another embodiment of the present invention.

FIG. 12 discloses another embodiment of the invention similar to the FIG. 4 embodiment except that rectilinear spring wires 80 are substituted for the helical wires 24 used in the FIG. 4 embodiment. Wires 80 are clipped to abutting coil runs 22*a* by clips 81. Additionally, wires 80 have a plurality of torsion arms 82 in the form of coils located centrally between the clips 81 and coil springs. This embodiment provides a firmer sleep surface than that which uses the helical wires 24 as shown in FIG. 4.

Although not shown in the embodiments described above, the torsion wires in another embodiment may have a sinusoidal shape and moreover, they may interconnect coils that are spaced from each other in the longitudinal direction of the core unit rather than just interconnecting laterally adjacent coils of adjacent rows of coils as in the embodiments shown in the drawings.

It will thus be seen that the present invention provides a full seven inch mattress core composed of conventional coil springs and which may be used in modern-day, low-height styled sofa beds with conventional linkage mechanisms and yet will provide a comfortable sleeping surface.

What is claimed is:

1. A spring assembly for use in a foldable sofa-bed mattress comprising in combination, a plurality of rows of coil springs extending in a first direction and having upper coil portions forming a sleep surface, means interconnecting adjacent coil springs in each row, and a plurality of torsion wires of spring wire material spaced from each other along said first direction and extending in a second direction transverse to said first direction and over said rows of coil springs while respectively interconnecting a plurality of said rows of coil springs, said torsion wires including intermediate portions extending transversely of said first direction and over said coil portions, said torsion wires each including offset portions spaced along the length thereof and extending generally in said first direction in generally horizontal single planes spaced from planes of adjacent runs of said coil springs while being connected to said upper coil portions of each row to provide torsional resistance to loads when in use, and wherein said torsion wires are located only on one side of the coil springs adjacent the sleep surface such that the strength of said one side is greater than the side opposite said one side, said offset portions of said torsion wires are connected to opposed portions of each of said upper coil portions and extend generally in a tangential direction relative to said opposed portions, said intermediate portions of said torsion wires are deflectable in torsion about torsion arms defined by said offset portions while avoiding bending about runs of adjacent coil springs, and said mattress is foldable in said first direction about an axis extending generally along said second direction.

2. The spring assembly defined in claim 1 wherein said offset portions are connected to generally diametrically opposite portions of said upper coil portions of each coil spring.

3. The spring assembly defined in claim 1 wherein said offset portions each have a generally U shape configuration.

4. The spring assembly defined in claim 3 further including rings extending about said offset portions and said upper coil portions to connect the offset portions thereto while allowing a certain amount of relative movement between said offset portions and said upper coil portions to which the offset portions are connected.

5. The spring assembly defined in claim 1 wherein said torsion wires include rectilinear portions and said offset portions each have a generally inverted S shape configuration extending laterally on opposite sides of said rectilinear portions.

6. The spring assembly defined in claim 5 further including rings extending about said offset portions and said upper coil portions to connect the offset portions thereto while allowiing a certain amount of relative movement between said offset portions and said upper portions to which the offset portions are connected.

7. The spring assembly defined in claim 1 wherein said offset portions each include coiled portions located between said offset portions respectively.

8. The spring assembly defined in claim 1 wherein said means interconnecting adjacent coils in each row include a plurality of additional torsion wires connected to adjacent coil springs in each row of coil springs and including offset portions located between the rows of coil springs.

9. The spring assembly defined in claim 1 further including rings extending about said offset portions and said upper coil portions to connect the offset portions thereto while allowing a certain amount of relative movement between said offset portions and said upper coil portions to which the offset portions are connected.

10. The spring assembly defined in claim 1 wherein said means interconnecting adjacent coil springs in each row include a plurality of helical wires extending in said second direction at locations spaced from each other and being respectively wound about adjacent coil springs in each of said rows to interconnect a plurality of said rows of coil springs.

11. The spring assembly defined in claim 10 wherein said helical wires and said torsion wires are each made from spring wire material.

* * * * *